US010684087B2

(12) United States Patent
Thomele et al.

(10) Patent No.: US 10,684,087 B2
(45) Date of Patent: Jun. 16, 2020

(54) HANDGUN SEAR WITH MULTIPLE ENGAGEMENT SURFACES

(71) Applicant: SIG SAUER, INC., Newington, NH (US)

(72) Inventors: Adrian Thomele, Stratham, NH (US); Sean P. Toner, Merrimack, NH (US); Albert Richard Larochelle, Manchester, NH (US); Keith Andrew Cornish, Barrington, NH (US); Mark Kimball, Exeter, NH (US); Andrew Phillip Loriot, Somersworth, NH (US); Matthew Thomas Barker, Epping, NH (US); Derek A. Oaks, Manchester, NH (US); Tyler Robert Thibodeau, Chester, NH (US); Joshua Robert Shoemaker, Rochester, NH (US); Eric Raymond Guillemette, Durham, NH (US); Michael D. Couture, Rochester, NH (US); Zachary Messier, Somersworth, NH (US); Jacob Thomas Shawley, Somersworth, NH (US); David Steimke, Epping, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 16/156,266

(22) Filed: Oct. 10, 2018

(65) Prior Publication Data

US 2019/0107353 A1 Apr. 11, 2019

Related U.S. Application Data

(60) Provisional application No. 62/570,623, filed on Oct. 10, 2017, provisional application No. 62/577,975, filed on Oct. 27, 2017.

(51) Int. Cl.
*F41A 19/12* (2006.01)
*F41A 19/32* (2006.01)

(52) U.S. Cl.
CPC ..... *F41A 19/32* (2013.01); *F41A 19/12* (2013.01)

(58) Field of Classification Search
CPC ..... F41A 19/12; F41A 19/14; F41A 19/06; F41A 19/15; F41A 19/32; F41A 19/31; F41A 19/44; F41A 19/45
See application file for complete search history.

(56) References Cited

U.S. PATENT DOCUMENTS 810,177 A * 1/1906 De Kiraly ..... F41A 19/10 42/69.01
1,827,037 A * 10/1931 Pedersen ..... F41A 3/26 89/154

(Continued)

FOREIGN PATENT DOCUMENTS

GB 2092279 * 12/1981 ..... F41A 17/72

*Primary Examiner* — Derrick R Morgan
(74) *Attorney, Agent, or Firm* — Finch & Maloney PLLC

(57) ABSTRACT

A handgun sear has a sear body extending between a proximal end portion to a distal end portion. The sear defines a first engagement surface adjacent the proximal end portion and a second engagement surface positioned distally of the first engagement surface. The sear can pivot about the distal end portion between a cocked position and a displaced position. The second engagement surface can be used to arrest forward movement of the striker in the event of an impulse that causes the striker to disengage from the first engagement surface. The sear may be incorporated into a fire control assembly of a semiautomatic handgun or other firearm.

20 Claims, 3 Drawing Sheets

(56) References Cited

U.S. PATENT DOCUMENTS 2,223,093 A * 11/1940 Brewer ..... F41A 19/32 89/143
2,474,180 A * 6/1949 Browning ..... F41A 19/42 42/69.01
2,514,981 A * 7/1950 Walker ..... F41A 17/32 42/70.01
2,585,620 A * 2/1952 Benson ..... F41A 19/32 89/150
2,613,577 A * 10/1952 De Kiraly ..... F41A 19/31 89/149
2,703,943 A * 3/1955 Roemer ..... F41A 19/42 42/70.08
2,748,661 A * 6/1956 Simpson ..... F41A 19/03 89/130
2,846,925 A * 8/1958 Norman ..... F41A 17/38 89/145
2,960,011 A * 11/1960 Bretton ..... F41A 3/38 89/182
3,079,718 A * 3/1963 Allyn ..... F41A 3/72 42/69.03
3,129,637 A * 4/1964 Packard ..... F41A 17/76 89/154
3,236,154 A * 2/1966 Iwashita ..... F41A 19/03 89/128
3,726,040 A * 4/1973 Cranston ..... F41A 19/12 42/69.01
3,797,154 A * 3/1974 Seecamp ..... F41C 7/06 42/69.03
3,901,126 A * 8/1975 Bretton ..... F41A 3/38 89/182
4,306,487 A * 12/1981 Beretta ..... F41A 17/64 89/148
4,321,764 A * 3/1982 Wilhelm ..... F41A 19/14 42/69.03
4,355,563 A * 10/1982 Swieskowski ..... F41A 19/03 89/130
4,458,578 A * 7/1984 Gerndt ..... F41A 19/31 42/69.02
4,505,182 A * 3/1985 Sullivan ..... F41A 3/72 89/132
4,671,005 A * 6/1987 Jewell ..... F41A 17/46 42/69.02
4,697,495 A * 10/1987 Beretta ..... F41A 11/00 89/142
4,745,843 A * 5/1988 Zedrosser ..... F41A 19/31 89/132
4,833,970 A * 5/1989 Wilhelm ..... F41A 19/33 89/141
5,251,394 A * 10/1993 Bornancini ..... F41A 17/56 42/70.05
5,303,494 A * 4/1994 Tuma ..... F41A 17/56 42/70.04
5,400,537 A * 3/1995 Meller ..... F41A 17/74 42/69.03
5,924,231 A * 7/1999 Kidd ..... F41A 19/44 42/42.01
6,263,607 B1 * 7/2001 Fuchs ..... F41A 17/36 42/70.01
6,415,702 B1 * 7/2002 Szabo ..... F41A 17/28 42/70.08
6,588,136 B2 * 7/2003 Baker ..... F41A 19/48 42/70.02
7,051,467 B1 * 5/2006 Huber ..... F41A 19/16 124/31
7,194,833 B1 * 3/2007 Curry ..... F41A 19/12 42/14
7,398,723 B1 * 7/2008 Blakley ..... F41A 19/12 42/69.01
8,250,799 B2 * 8/2012 Duperry ..... F41A 19/16 42/42.02
8,572,878 B2 * 11/2013 Gentilini ..... F41A 17/72 42/69.01
8,677,665 B1 * 3/2014 Huber ..... F41A 19/12 42/69.01
9,267,750 B1 * 2/2016 Tubb ..... F41A 19/16
9,310,150 B1 * 4/2016 Geissele ..... F41A 19/16
9,915,490 B2 * 3/2018 Gentilini ..... F41A 17/72
10,030,927 B1 * 7/2018 Theiss ..... F41A 19/12
10,378,847 B2 * 8/2019 Folk ..... F41A 17/72
2006/0086030 A1 * 4/2006 Moore ..... F41A 19/48 42/69.03
2006/0150466 A1 * 7/2006 Hochstrate ..... F41A 17/72 42/69.03
2009/0044437 A1 * 2/2009 Zajk ..... F41A 19/10 42/65
2011/0079137 A1 * 4/2011 Audibert ..... F41A 19/10 89/136
2011/0094139 A1 * 4/2011 Atzl ..... F41A 19/12 42/69.01
2011/0162248 A1 * 7/2011 Trpcic ..... F41A 17/56 42/108
2011/0289811 A1 * 12/2011 Gentilini ..... F41A 17/72 42/69.02
2013/0000171 A1 * 1/2013 da Silveira ..... F41A 19/12 42/69.01
2013/0167423 A1 * 7/2013 Lupher ..... F41A 17/06 42/70.06
2013/0174460 A1 * 7/2013 Aigner ..... F41A 19/12 42/69.01
2014/0311006 A1 * 10/2014 Kott ..... F41A 19/16 42/69.01
2015/0211822 A1 * 7/2015 Hirschheiter ..... F41A 19/10 42/69.01
2015/0323274 A1 * 11/2015 Toner ..... F41A 17/56 42/70.01
2016/0018176 A1 * 1/2016 Fellows ..... F41A 19/02 42/69.03
2016/0084600 A1 * 3/2016 Siddle ..... F41A 19/31 42/69.01
2017/0059267 A1 * 3/2017 Hudson, III ..... F41A 19/12
2017/0131053 A1 * 5/2017 Fumia ..... F41A 19/12
2017/0299323 A1 * 10/2017 Nachefski ..... F41A 17/56
2018/0195823 A1 * 7/2018 Schafer ..... F41A 19/31
2019/0107353 A1 * 4/2019 Thomele ..... F41A 19/32
2019/0195582 A1 * 6/2019 Thomele ..... F41A 3/84
2019/0195587 A1 * 6/2019 Thomele ..... F41A 17/60
2019/0257609 A1 * 8/2019 Bascom ..... F41A 17/56

* cited by examiner

HANDGUN SEAR WITH MULTIPLE ENGAGEMENT SURFACES

RELATED APPLICATIONS

This application claims priority under 35 U.S.C. § 119(e) to U.S. Provisional Patent Application No. 62/570,623, filed on Oct. 10, 2017, and titled HANDGUN SEAR WITH MULTIPLE CATCH SURFACES; this application also claims priority under 35 U.S.C. § 119(e) to U.S. Provisional Patent Application No. 62/577,975 filed on Oct. 27, 2017, and titled HANDGUN SEAR WITH MULTIPLE ENGAGEMENT SURFACES. The contents of these applications are incorporated herein by reference in their entireties.

FIELD OF THIS DISCLOSURE

This disclosure relates to fire control components in firearms and more particularly to a handgun sear.

BACKGROUND

Traditionally, handguns have included a metal frame and receiver as a single component to which additional components are attached, such as the fire control group, barrel, slide, safety levers, grips, and other parts of the handgun. The advent of polymer-framed handguns has been accompanied by new challenges in firearms design. Instead of a steel frame that also serves as the receiver, polymer-framed handguns commonly have a polymer frame that extends along the barrel and includes a hand grip and trigger guard. A separate metal receiver is installed into a receiver box defined in the top of the frame. The receiver includes components of the fire control group. A slide, often made of metal, attaches to and moves along rails on top of the receiver. Many polymer-framed handguns are striker-fired, where the action includes a striker held in spring tension until released forward to impact the ammunition primer when the user pulls the trigger.

SUMMARY

The present disclosure relates to improvements in the fire control group in firearms and safety aspects thereof. Aspects of the present disclosure include a sear for a handgun or other firearm, a fire control group including the sear, and a handgun including the sear. In one embodiment, a handgun sear includes a plurality of engagement surfaces. Each engagement surface is configured to engage the striker to prevent the striker from moving forward to strike the ammunition primer. For example, the first engagement surface is configured to retain the striker in the cocked position and to release the striker when the user pulls the trigger to discharge the handgun. The second engagement surface can engage the striker catch to halt forward movement of the striker when the striker is unintentionally released from the first engagement surface, such as due to an impulse. Principles of the present disclosure can be applied to semiautomatic handguns whether striker-fired or hammer-fired, revolvers, rifles, machine guns, and shotguns.

Example 1 is a handgun sear comprising a sear body extending between a distal end portion defining a pivot opening and a proximal end portion with a spring guide. The sear body defines a first engagement surface adjacent the proximal end portion and a second engagement surface between the first engagement surface and the distal end portion. The first engagement surface and the second engagement surface face proximally.

Example 2 includes the subject matter of Example 1, wherein the first engagement surface and the second engagement surface are defined along a top portion of the sear body.

Example 3 includes the subject matter of Examples 1 or 2, wherein when the first engagement surface is oriented vertically, a first tip of the first engagement surface is vertically higher than a second tip of the second engagement surface.

Example 4 includes the subject matter of any of Examples 1-3, wherein the second engagement surface is defined by a recess in the top portion located distally of the first engagement surface.

Example 5 includes the subject matter of any of Examples 1-4, wherein one or both of the first engagement surface and the second engagement surface is defined by a vertical face connected to an upwardly sloping surface along the top portion of the sear body.

Example 6 is a fire control assembly for a handgun, the assembly comprising a sear with a top portion extending from a proximal end portion and a distal end portion, wherein the top portion defines a first engagement surface adjacent the proximal end portion and a second engagement surface positioned distally of the first engagement surface. The sear is pivotable about the distal end portion between a cocked position and a displaced position. One or more sear springs engage the sear to bias the sear towards the cocked position. A striker with a striker catch is movable along a bore axis between a rearward position and a forward position, wherein the striker catch engages the first engagement surface when the striker is in the rearward position and the sear is in the cocked position. Except when the sear is moved to the displaced position as a result of user action, the sear is configured to recover from the displaced position and move to a recovered position with the second engagement surface in the path of the striker catch. When the striker catch disengages from the first engagement surface, it moves forward and the striker catch engages the second engagement surface in its path.

Example 7 includes the subject matter of Example 6, wherein the user action includes a trigger pull.

Example 8 includes the subject matter of Example 6, wherein the user action includes operating a takedown lever operable to pivot the sear when the takedown lever is moved to a takedown position.

Example 9 includes the subject matter of any of Examples 6-8, wherein the user action maintains the sear in the displaced position for more than 0.05 second.

Example 10 includes the subject matter of Example 9, wherein the user action maintains the sear in the displaced position for more than 0.1 second.

Example 11 includes the subject matter of Example 9, wherein the user action maintains the sear in the displaced position for more than 0.2 second.

Example 12 includes the subject matter of any of Examples 6-11 wherein the displaced position is a fully displaced position of the sear.

Example 13 includes the subject matter of any of Examples 6-12, wherein the sear moving to the displaced position is due to an impulse.

Example 14 is a semiautomatic handgun comprising a sear with a top portion extending between a distal end portion defining a pivot opening and a proximal end portion, where the top portion defines a first engagement surface adjacent the proximal end portion and a second engagement surface between the first engagement surface and the distal end portion. The first engagement surface and the second engagement surface face proximally. The sear is pivotable about the pivot opening between a cocked position and a displaced position. One or more sear springs bias the sear towards the cocked position. A striker with a striker catch is movable along a bore axis between a rearward position and a forward position, where the striker catch engages the first engagement surface when the striker is in the rearward position and the sear is in the cocked position. Except when the sear is moved to the displaced position as a result of user action, the sear is configured to recover from the displaced position to engage the striker catch and arrest distal movement of the striker.

Example 15 includes the subject matter of Example 14, wherein the user action includes a trigger pull.

Example 16 includes the subject matter of Example 15, wherein the user action further includes moving a takedown lever to a takedown position, thereby causing the striker to disengage from the sear.

Example 17 includes the subject matter of any of Examples 14-16, wherein the user action maintains the sear in the displaced position for more than 0.05 second.

Example 18 includes the subject matter of Example 17, wherein the user action maintains the sear in the displaced position for more than 0.1 second.

Example 19 includes the subject matter of Example 17, wherein the user action maintains the sear in the displaced position for more than 0.2 second.

Example 20 includes the subject matter of any of Examples 14-15 and 17-19, wherein the displaced position is sufficient to disengage the striker catch from the first engagement surface.

Example 21 includes the subject matter of any of Examples 14-20, wherein the displaced position is a fully displaced position of the sear.

Example 22 includes the subject matter of any of Examples 14-21, wherein the sear moving to the displaced position is due to an impulse.

Example 23 includes the subject matter of any of Examples 14-22, wherein the sear moving to the displaced position results in an unintended striker release from the first engagement surface.

Example 24 includes the subject matter of any of Examples 14-23, wherein when the first engagement surface is oriented vertically, a tip of the first engagement surface is vertically higher than a tip of the second engagement surface.

Example 25 includes the subject matter of any of Examples 14-24, wherein the second engagement surface is defined at least in part by a recess in the top portion of the sear.

Example 26 includes the subject matter of any of Examples 14-25, wherein one or both of the first engagement surface and the second engagement surface has a vertical face connected to an upwardly sloping surface along the top portion of the sear body.

Example 27 includes the subject matter of any of Examples 14-26, wherein the top portion of the sear is aligned along a path of the striker catch.

Example 28 includes the subject matter of any of Examples 14-27, wherein when the sear is displaced to a break position with the first tip moved out of a path of the striker catch, the second tip is also out of the path of the striker catch.

Example 29 is a fire control group including a sear with a sear body extending between a distal end portion and a proximal end portion. The sear is pivotable about the distal end portion between a cocked position or upward position and a displaced position or downward position. The sear has a first engagement surface and a second engagement surface, where the second engagement surface is positioned between the first engagement surface and the sear pivot pin. For example, the first engagement surface and the second engagement surface are defined along a top portion of the sear body. A sear spring (or springs) biases the sear towards the cocked position where it can engage the striker to prevent the striker from moving forward. A striker is movable between a rearward position and a forward position. The striker has a striker catch positioned to engage the first engagement surface when the sear is in the cocked position and when the striker is in the rearward position. The sear is configured so that either the first engagement surface or the second engagement surface will interfere with forward movement of the striker except when the sear is displaced to the downward position by a trigger pull, by a decocking assembly that releases the striker from the sear, or some other user action. For example, if the striker becomes disengaged from the first engagement surface due to a sudden force (i.e., an impulse), the sear can recover towards the upward or cocked position with the second engagement surface in the path of the striker catch before the striker catch travels forward beyond the second engagement surface. Thus, an unintentional striker release does not result in discharge of the firearm.

Example embodiments in accordance with the present disclosure can be provided as a stand-alone component (e.g., a sear), a retrofit or replacement component in a kit, a component assembled with a receiver, or a component of a fire control group of an assembled semiautomatic handgun utilizing a blowback, locked breech, delayed blowback, or hesitation lock operation. For example, the handgun can be a striker-fired or hammer-fired semiautomatic handgun. A sear of the present disclosure can be part of a fire control group in a handgun chambered for any suitable handgun ammunition, including but not limited to 0.22 LR, 0.380 Auto, 9 mm Luger, 10 mm, 0.40 S&W, 0.357 SIG, 0.45 ACP or the like. The sear can also be part of the fire control assembly of a rifle or shotgun. Other suitable host firearms and fire control assemblies will be apparent in light of the present disclosure.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the disclosed subject matter.

Figure 1:
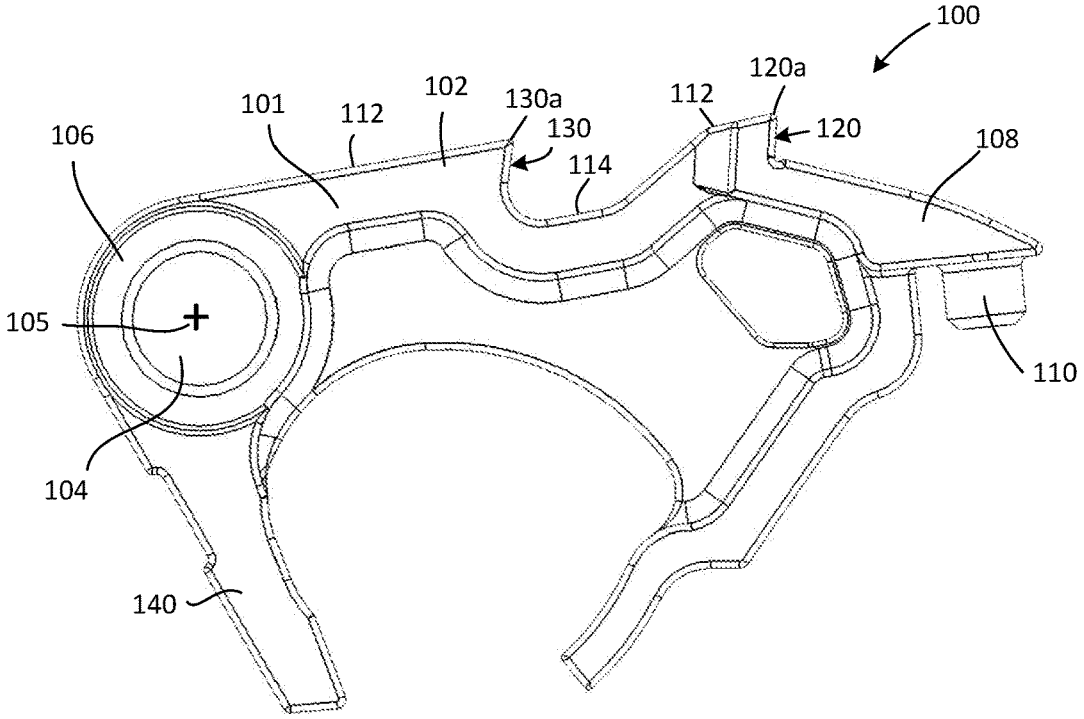
FIG. 1 illustrates a left-side elevational view of a handgun sear, in accordance with an embodiment of the present disclosure.

These and other features of the present disclosure will be better understood by reading the following detailed description, taken together with the Figures herein described. In the drawings, each identical or nearly identical component that is illustrated in various figures may be represented by a like numeral. For purposes of clarity, not every component may be labeled in every drawing. Furthermore, as will be appreciated, the figures are not necessarily drawn to scale or intended to limit the present disclosure to the specific configurations shown. In short, the Figures are provided merely to show example structures.

DETAILED DESCRIPTION

As noted above, non-trivial issues arise that complicate firearms design and their performance, including safety mechanisms. Safety is one concern that guides firearms design. For some firearms, certain events may occur that cause the striker to unintentionally disengage from the sear. Even if extremely rare, such an unintended striker release is a safety concern because the striker is released forward after disengagement from the sear by an event other than the user pulling the trigger, pressing a decocker, actuating a safety lever, moving a takedown lever to the takedown position, or other user action that intentionally releases the striker as part of normal operation of the firearm. An unintended striker release can result, for example, from mishandling the firearm, sudden impact, an impulse, or some other event. It would be desirable to prevent or reduce the likelihood of such unintended striker releases in semiautomatic handguns and other firearms.

In accordance with embodiments of the present disclosure, a sear for a handgun is configured to prevent the striker from striking the ammunition primer in the event of an unintended striker release, therefore avoiding an unintentional discharge. In one embodiment, the sear defines a first catch surface and a second catch surface along the top surface of the sear body. The first catch surface is configured to hold the striker in a cocked position. When the sear is displaced to its downward position by user action, such as pulling the trigger, the sear catch disengages from the first catch surface and travels forward to strike the ammunition primer (or an equivalent position). In the event that the first catch surface of the sear inadvertently disengages from the striker catch, the sear returns sufficiently towards the upward position as the striker begins to move forward so that the second catch surface engages the striker catch, thereby arresting forward movement of the striker before it can strike the ammunition primer.

In some embodiments, for example, user action holds the sear in a downward position long enough for the striker catch to pass the second catch surface. The user action may be a trigger pull, operating a decocker, or operating a takedown lever. In some embodiments, the time the sear remains in the downward position as a result of user action is significantly more than the time required for the striker catch to pass the second catch surface. In contrast, an impulse or other event that disengages the striker catch from the sear can have a sufficiently short duration that the sear can return towards the upward position with the second catch surface in the path of the striker catch before the striker catch moves beyond that point. This may be the case even when the sear is displaced fully. As such, the striker catch engages the second catch surface and stops forward movement of the striker.

General Overview

Aspects of a sear, fire control group, and handgun assembly are disclosed. In accordance with some embodiments of the present disclosure, a sear for a handgun includes at least two engagement surfaces for engaging the striker when the striker is held in a rearward position under spring tension. If the striker is unintentionally released from the first engagement surface, a second engagement surface will move into the path of the striker catch to stop the striker from moving forward to strike the ammunition primer. In one embodiment, for example, the sear includes a first engagement surface or hook that engages the striker catch when the striker is in the cocked position. The first engagement surface on the sear can be used during normal operation of the handgun to engage the striker and retain the striker in the cocked position as well as to release the striker to discharge the firearm. The sear includes a second engagement surface or hook in the general path of the striker catch as it moves from the fully cocked position to the firing position. If the sear is displaced sufficiently to disengage the striker catch from the first engagement surface, such as may occur as a result of an impulse, the sear will recover toward the cocked position so that the second engagement surface moves into the path of and engages the striker catch as the striker begins to move forward, thereby preventing the striker from striking the ammunition primer. The second engagement surface on the sear is intended to arrest forward striker movement after an unintended striker release and prevent the striker from moving forward to strike the ammunition primer. For example, the striker catch can engage all or part of the second engagement surface on the sear. At the same time, the sear is configured so that the striker catch bypasses the second engagement surface on the sear when the striker is released from the first engagement surface due to user action, such as the user pulling the trigger, in accordance with some embodiments. For example, when the user pulls the trigger, the sear pivots downward for a time sufficient to allow the striker catch to move past the second engagement surface before the sear returns to its cocked position. Even when the user fires the firearm in one's fastest possible succession, the striker moves beyond the second engagement surface well before the sear returns to the cocked position. Thus, the second engagement surface does not interfere with normal operation of the firearm.

In one example embodiment, the sear can pivot about the distal end portion of the sear and the sear is biased toward the upward or cocked position by one or more sear springs extending between the frame or receiver and the proximal end portion of the sear. The first engagement surface is positioned along a top portion of the sear body at the proximal end portion of the sear. When the user pulls the trigger, a trigger bar pivots the proximal end portion of the sear downward so that the first engagement surface disengages from the striker catch. The sear is held in the downward position by the trigger bar until released by the disconnector during the regular sequence of events associated with a trigger pull. In contrast, an impulse or sudden impact force can potentially pivot the sear downward and release the striker catch from the sear's first engagement surface. Depending on the amplitude and direction of the impulse, the sear may pivot downward enough for the striker catch to disengage from the sear's first engagement surface. Even when the sear pivots fully downward to a stop, the sear recovers towards the cocked position with the second engagement surface engaging the striker catch and stopping distal movement of the striker towards the firing position. For example, the second engagement surface is spaced distally from the first engagement surface along the top portion of the sear so that the sear recovers sufficiently to engage the striker catch and stop the striker's forward movement. Accordingly, the second engagement surface is positioned to prevent the striker from striking the ammunition primer as a result of an unintended striker release.

Embodiments of a sear according to the present disclosure advantageously improve safety of semiautomatic handguns and other firearms by providing a second engagement surface on the sear that can engage the striker catch after it disengages from the first catch and begins to move forward due to an impulse or other event causing an unintentional striker release.

As discussed herein, terms referencing direction, such as upward, downward, vertical, horizontal, left, right, front, back, etc., are used for convenience to describe embodiments as shown in the figures with the handgun in a conventional shooting position in which the barrel is oriented horizontally and grip extending down from the handgun frame. Embodiments according to the present disclosure are not limited by these directional references and it is contemplated that a handgun and its components discussed herein could be used in any orientation As will be appreciated in light of this disclosure, and in accordance with some embodiments, features of the sear can be used with semiautomatic striker-fired handguns. The sear and fire control assembly of the present disclosures is not limited to a striker-fired handgun, and can be configured for use in hammer-fired handguns and other firearms. The principles of the present disclosure can also be applied to the sear of pistol-caliber carbines, rifles, shotguns, short-barreled rifles, machine guns and other firearms. In accordance with some example embodiments, a sear with a first engagement surface and a second engagement surface is provided as part of a semiautomatic handgun chambered in 0.380 Auto, 9 mm Luger, 0.357 SIG, 10 mm Auto, 0.40 S&W, 0.45 ACP, or other suitable pistol ammunition. Other suitable host firearms and chamberings will be apparent in light of this disclosure.

In accordance with some embodiments, the disclosed apparatus may be detected, for example, by visual inspection of a handgun or handgun subassembly that includes a sear having a first engagement surface and a second engagement surface. While generally referred to herein as a sear for ease of understanding the present disclosure, the disclosed sear is not limited to that specific terminology and alternatively can be referred to, for example, as a striker release mechanism or other terms. Also, it should be noted that, while generally referred to herein as an engagement surface for consistency and ease of understanding the present disclosure, the disclosed sear is not limited to that specific terminology and each engagement surface alternatively can be referred to, for example, as a catch, a catch surface, a catch recess, a sear hook, a catch protrusion, or other terms. As will be further appreciated, the particular configuration (e.g., materials, dimensions, etc.) of a sear configured as described herein may be varied, for example, depending on whether the intended use is military, tactical, or civilian in nature. Numerous configurations will be apparent in light of this disclosure.

Structure and Operation

Referring to FIG. 1, a left-side elevational view illustrates a sear 100 in accordance with an embodiment of the present disclosure. Sear 100 has a sear body 101 with a top portion 102 extending from a distal end portion 106 to a proximal end portion 108. Distal end portion 106 defines a pin opening 104. Proximal end portion 108 defines a spring receptacle 110, such as a pin or recess. Top portion 102 of sear 100 defines a first engagement surface 120 adjacent proximal end portion 108 and a second engagement surface 130 positioned distally of first engagement surface 120. For example, second engagement surface 130 is positioned roughly half-way along sear body 101 between first engagement surface 120 and pivot opening 104. One or both of engagement surfaces 120, 130 can be defined by a recess, protrusion, ridge, lip, hook, notch, or other feature configured to engage striker catch 20 as discussed in more detail below. In some embodiments, sear 100 has a lower arm 140 extending downward from sear body 101 adjacent pivot opening 104. The lower arm 140 can be configured to be operably engaged by a trigger bar 32 to pivot sear 100 about the pivot axis 105. It is contemplated that first engagement surface 120 and second engagement surface 130 can be defined along other portions of sear 100, depending on the location of other components in a particular fire control assembly, as will be appreciated.

Sear 100 can pivot about distal end portion 106 between a cocked position (e.g., up position) and a firing position (e.g., down position). In some embodiments where the handgun is positioned in a conventional shooting position with the barrel oriented horizontally and grip extending downward, a tip 130*a* of second engagement surface 130 is positioned vertically below a tip 120*a* of first engagement surface 120 when sear 100 is in the cocked position with striker catch 20 engaging first engagement surface 120. For example, sear body 101 includes one or more sloping sections 112 that extend upwardly in a proximal direction to tips 120*a*, 130*a* at the top of first and second engagement surfaces 120, 130, respectively. Each sloping section 112 connects to a substantially vertical (e.g., ±5°) face that defines first engagement surface 120 or second engagement surface 130. In another embodiment, second engagement surface 130 is defined by a recess or notch 114 in top portion 102 of sear body 101 between first engagement surface 120 and distal end portion 106.

In some embodiments, first engagement surface 120 is not parallel to second engagement surface 130. For example, when first engagement surface 120 extends vertically, second engagement surface 130 extends at an angle of about 82-87° with respect to the vertical. That is, second engagement surface 130 is angled proximally about 3-8°, such as 5°, to provide a more definite engagement with striker catch 20.

Figure 2:
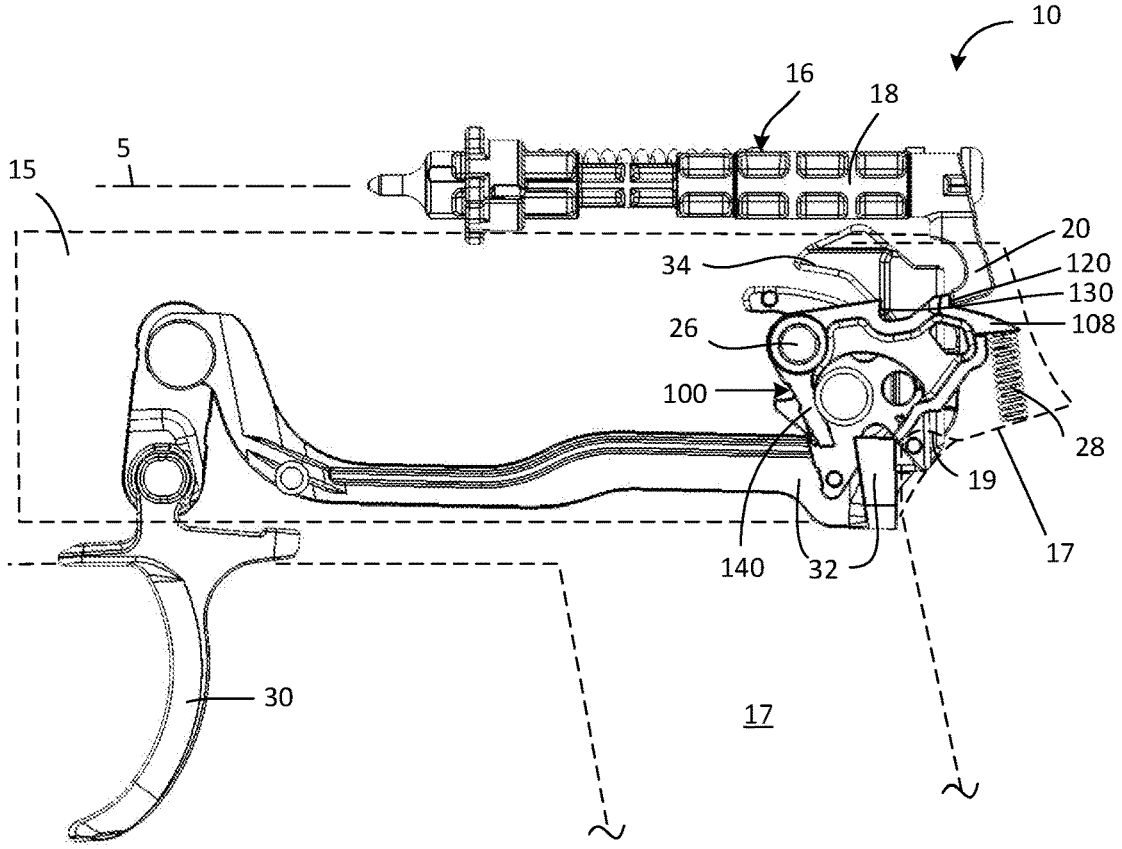
FIG. 2 illustrates a left-side elevational view of a portion of a handgun frame and a receiver shown in broken lines along with a fire control assembly that includes a striker, where the sear is shown in a cocked position with the striker catch engaging the first engagement surface of the sear, in accordance with an embodiment of the present disclosure.

Referring now to FIG. 2, a left-side elevational view illustrates components of a fire control assembly 10 of a handgun in accordance with an embodiment of the present disclosure. The fire control assembly 100 is retained in a receiver 15 (shown in broken lines) that is installed in the handgun frame 17 (also shown in broken lines). Fire control assembly 10 includes a striker 16 with a striker body 18 that extends longitudinally along a bore axis 5 and having a striker catch 20 extending down from striker body 18. Striker 16 is longitudinally displaceable along bore axis 5 between a forward or firing position and a rearward or cocked position. In FIG. 2, sear 100 is shown in the upward or cocked position with striker catch 20 engaging first engagement surface 120. Striker 16 is retained against spring forces in the cocked position by engagement between striker catch 20 and sear 100. In the forward position (not shown), striker 16 has moved forward (proximally) aided by spring forces to impact an ammunition primer (not shown) or attain an equivalent position.

In one embodiment, sear 100 pivots about a pin 26 extending laterally into or through receiver 15. Sear 100 can pivot between an upward or cocked position (shown in FIG. 2) and a downward or displaced position (shown in FIGS. 3-5). In some embodiments, the movement of sear 100 is constrained between an upward stop in the cocked position and a downward stop in the displaced position. For example, proximal end portion 108 of sear 100 abuts a lug 19 or other portion of frame 17 serving as a downward stop. In another example, striker catch 20 acts as an upward stop for sear 100. In other examples, components of fire control group 10 define upward and/or downward stop for sear 100. In some embodiments, sear 100 pivots approximately 5° to 30° from the upward stop at the cocked position to the downward stop at the fully displaced position.

A sear spring 28 is positioned to bias sear 100 towards the cocked position. For example, sear spring(s) 28 is disposed between frame 17 of the handgun and a proximal end portion 108 of sear 100. In other embodiments, sear spring(s) 28 can engage a portion of receiver 15. Sear spring(s) 28 engages proximal end portion 108 of sear 100 to pivot sear 100 about pin 26 to the upward or cocked position as shown, for example, in FIG. 2. In the ordinary course of operation, sear 100 can be displaced to the downward position when the user pulls a trigger 30, which causes a trigger bar 32 to move distally and engage lower arm 140. As trigger bar 32 engages lower arm 140 of sear 100, top portion 102 of sear 100 pivots downward against the force of sear spring 28. As sear 100 pivots downward to a break position or beyond, first engagement surface 120 disengages from striker catch 20 and releases striker 16 forward. In some embodiments, a disconnector 34 maintains sear 100 in the displaced position until after the firing cycle has proceeded and/or the trigger 16 is released by the user, thereby allowing sear spring 28 to return sear 100 to the cocked position.

In some embodiments, the handgun can also include a safety bar operably connected to the takedown lever, where moving the takedown lever to the takedown position pivots sear 100 to the displaced position to release striker 16 in preparation for takedown. For example, the safety bar engages lower arm 140 of sear 100 similar to the action of trigger bar 32. Moving the takedown lever to the takedown position is part of disassembling the handgun for service and cleaning. An example of one such takedown lever is disclosed in U.S. Pat. No. 9,303,936, which is incorporated herein by reference in its entirety.

In contrast to releasing striker 16 by user action, such as pulling trigger 30 or operating the takedown lever, sear 100 can be inadvertently displaced in rare circumstances due to an impulse or sudden impact force. The displacement of sear 100 can result in striker 16 disengaging from sear 100. After being displaced by the impulse, sear 100 is not retained in the displaced position, but instead returns after the impulse ends towards the cocked position due to the force of sear spring(s) 28. For example, an impulse may have a duration of 0.05 second or less, such as about 0.002 second or less, or even 0.0005 second, which is comparatively much shorter than displacement of sear 100 during a trigger pull (e.g., ~0.1 to 0.5 second or more) or other user action.

Figure 3:
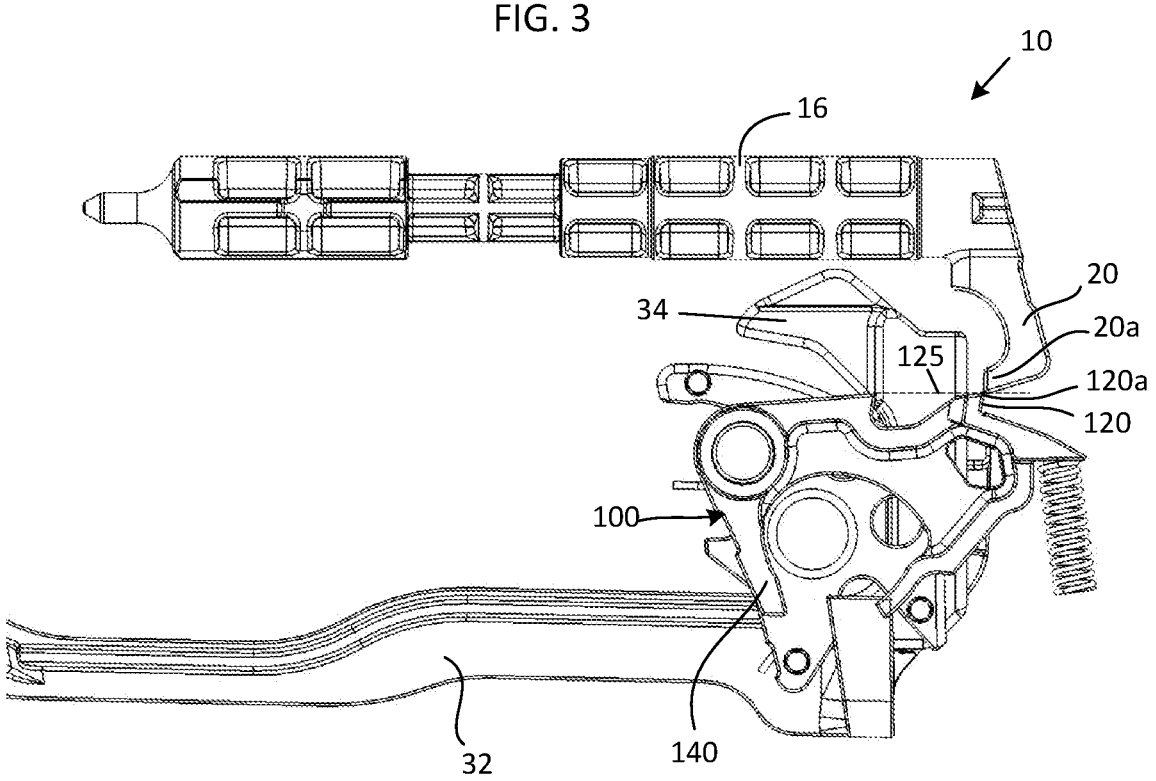
FIG. 3 illustrates a left-side elevational view of a fire control assembly with the striker and sear in a break position with a tip of the striker catch positioned to clear the tip of the first engagement surface of the sear, in accordance with an embodiment of the present disclosure.
Figure 4:
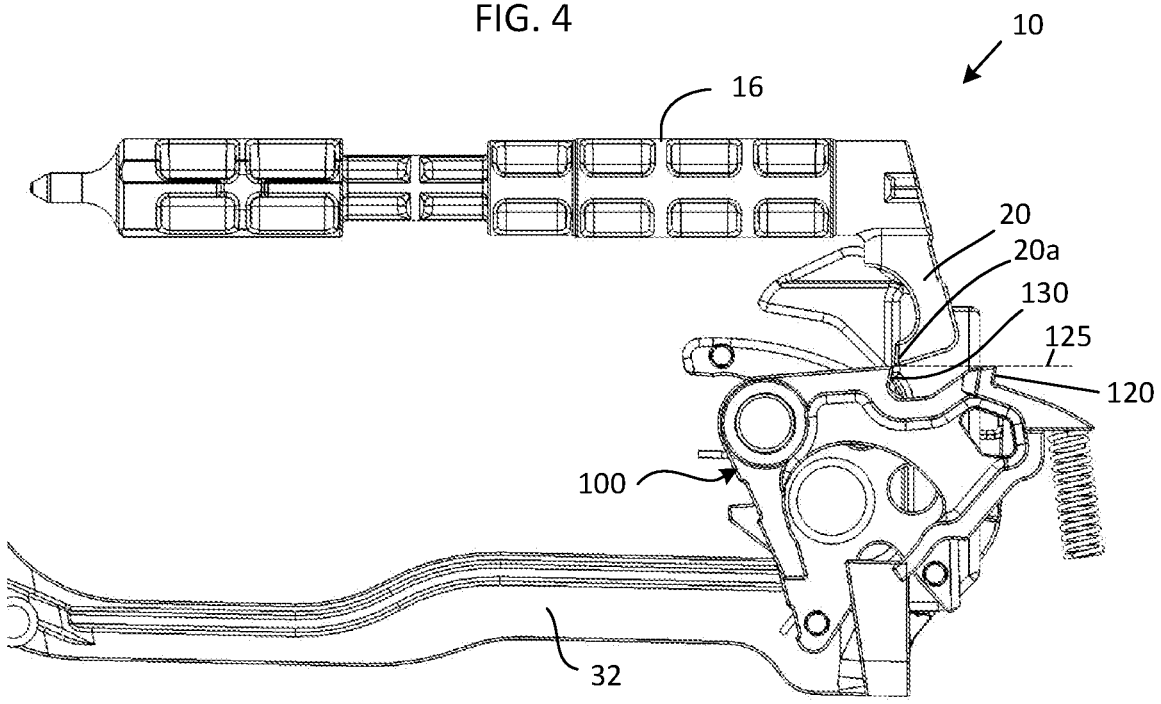
FIG. 4 illustrates a left-side elevational view of components of the fire control group of FIG. 3, where the striker is moved partially forward with clearance between the striker catch and the second engagement surface when the sear is in the break position, in accordance with an embodiment of the present disclosure.

FIG. 3 illustrates a left-side view of the fire control assembly of FIG. 2 with sear 100 pivotably displaced to a break position where the tip 20*a* of striker catch 20 is even with a tip 120*a* of first engagement surface 120. In the break position, striker catch 20 just clears first engagement surface 120 to allow striker 16 to move distally. In the break position, second engagement surface 130 is even with or just below a path 125 of tip 20*a* of striker catch 20 as shown in FIG. 4. Accordingly, when sear 100 is pivoted to the break position due to a trigger pull, striker catch 20 is released from first engagement surface 120 and also clears second engagement surface 130. During a trigger pull, for example, top portion 102 of sear 100 will remain at or below the path 125 of the striker catch 20 for a time sufficient to allow striker 16 to move distally past second engagement surface 130 to strike the ammunition primer. During the trigger pull, sear 100 also will continue to pivot downward from the break position to the lower stop position due to trigger 30 (shown in FIG. 2) having some overtravel beyond the break position. As a result, sear 100 remains displaced at or below the path 125 of striker catch 20 significantly longer than the time required for striker 16 to travel distally to strike the ammunition primer (or an equivalent position). Therefore, second engagement surface 130 does not obstruct or interfere with striker 16 moving forward to strike the ammunition primer during a trigger pull by the user.

In contrast, if sear 100 is displaced to the break position due to an impulse, sear 100 recovers upward past the break position towards the cocked position by pivoting upward. This recovery toward the cocked position can position second engagement surface 130 in the path 125 of striker catch 20. In some embodiments, tip 130*a* of second engagement surface 130 is positioned just below path 125 of striker catch 20. Thus, any recovery of sear 100 from the break position before striker catch 20 moves distally beyond second engagement surface 130 results in second engagement surface 130 moving into the path 125 of striker catch 20. In doing so, second engagement surface 130 engages striker catch 20 and arrests the forward movement of striker 16. In some embodiments, for example, the minimum displacement of sear 100 to the break position where striker catch 20 disengages from first engagement surface 120 is from 4-7° from the cocked position.

In some embodiments, sear 100 is configured so that the movement of sear 100 from the downward stop (i.e., fully displaced or fully downward position) to the upward stop of the cocked position occurs in less time than required for striker catch 20 to move distally from first engagement surface 120 to second engagement surface 130. Accordingly, in an unintended striker release, second engagement surface 130 moves into the path of striker catch 20 before striker catch 20 moves distally beyond it for any amount of sear displacement. In some instances, striker catch 20 may disengage from and then reengage first engagement surface 120 when sear 100 is not displaced to the break position or beyond.

In some instances of an unintended striker release, for example, sear 100 may not pivot fully to the downward stop, but instead may pivot beyond the break position by an amount less than the full range of sear movement. Thus, second engagement surface 130 can engage striker catch 20 to prevent discharge during an unintended striker release with any amount of sear 100 displacement, including full displacement to the downward stop. In another example, the impulse is strong enough for sear 100 to displace fully to the downward stop and "bounce" off the downward stop towards the cocked position. In such a situation, second engagement surface 130 moves into the path 125 of striker catch 20 to arrest the forward movement of striker 16. In some embodiments, an impulse causes striker catch 20 to disengage from first engagement surface 120, such as causing vibration and movement of sear 100 and/or striker 16, but sear 100 recovers sufficiently to the cocked position so that first engagement surface re-engages striker catch 20. Thus, subject to the magnitude of the impulse, either first engagement surface 120 or second engagement surface 130 can engage striker catch 20 after an unintended striker release to prevent striker 16 from traveling distally to strike the ammunition primer (or equivalent position).

Figure 5:
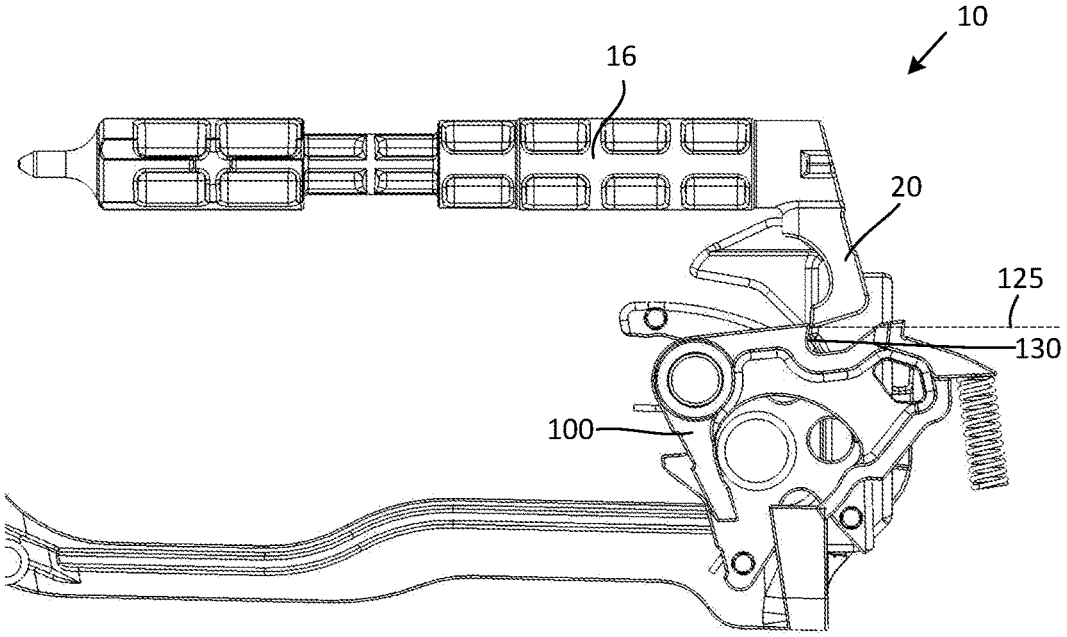
FIG. 5 illustrates a left-side elevational view of components of the fire control assembly of FIG. 3, showing the sear partially recovered from the break position towards the cocked position and the striker catch engaging the second engagement surface, in accordance with an embodiment of the present disclosure.
Figure 6:
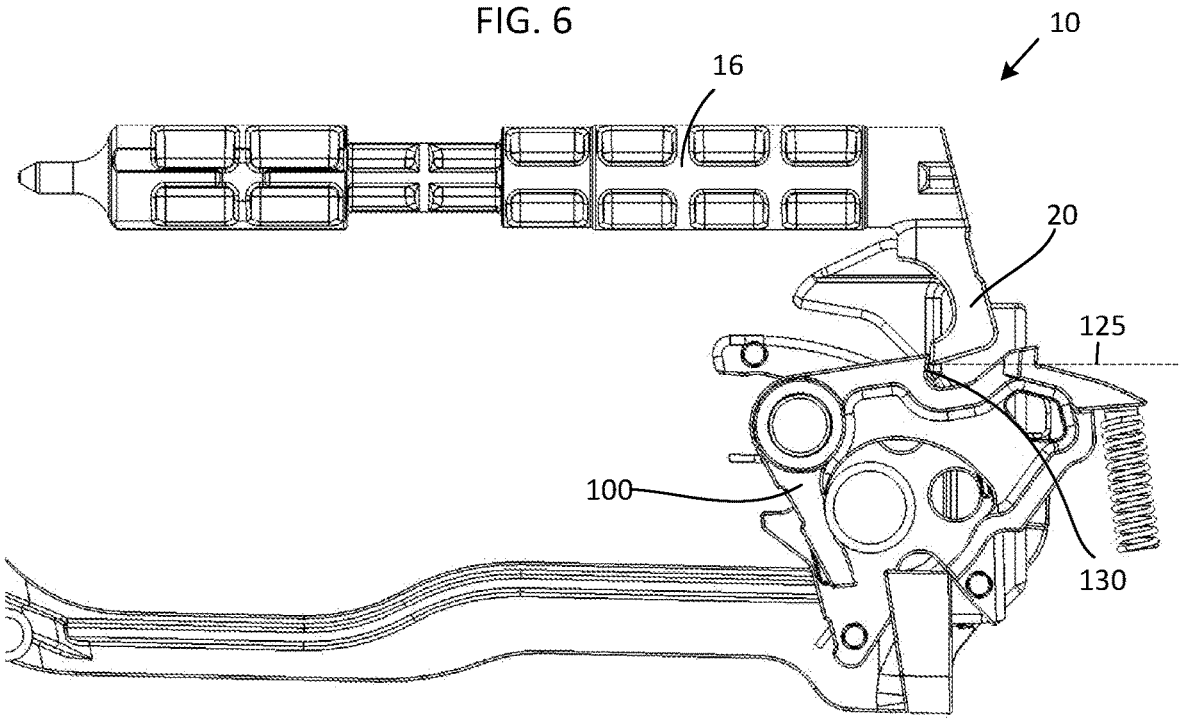
FIG. 6 illustrates a left-side elevational view of the fire control assembly of FIG. 3 with the sear recovered to the cocked position after being displaced to the break position, where the striker catch engages the second engagement surface of the sear, in accordance with an embodiment of the present disclosure.

FIG. 5 illustrates a left-side view of fire control assembly 10 of FIG. 2 with sear 100 in a position of having recovered upward about 1.5° from the break position. Second engagement surface 130 is in the path 125 of and engages striker catch 20 to arrest further distal movement of striker 16. FIG. 6 illustrates sear 100 recovered from the break position to the cocked position of FIG. 2. Here, sear 100 has recovered fully from a displacement of about 4.5° to the break position, where second engagement surface 130 has moved into path 125 to engage striker catch 20.

In some embodiments, first engagement surface 120 and second engagement surface 130 are spaced and oriented relative to each other to enable second engagement surface 130 to engage striker catch 20 during an unintended striker release. In some embodiments, an unintended striker release involves displacement of sear 100 by an amount less than the sear's full range of movement. In some embodiments, sear 100 is configured to return sufficiently towards the upward or cocked position after an unintended striker release so that a displacement of 15° or less results in engagement of sear 100 with striker catch 20, including 13° or less, 11° or less, 10° or less, 9° or less, 8° or less, 7° or less, 6° or less, 5° or less, 4° or less, or 3° or less.

In some embodiments, sear 100 is configured to recover sufficiently towards the cocked position from an unintended displacement of any amount where first engagement surface 120 or second engagement surface 130 moves into the path 125 of striker catch 20 prior to striker catch 20 moving distally beyond second engagement surface 130. In some embodiments, sear 100 can be displaced beyond the break position only a relatively small amount. In other embodiments, the break position may be 50-75% of the sear's full range of movement. Accordingly, in some embodiments, second engagement surface 130 can be positioned to engage striker catch 20 when sear 100 is displaced to its full range of movement or some amount less than the full range of sear movement. For example, sear spring(s) 28 provide sufficient spring force to result in second engagement surface 130 engaging striker catch 20 after an unintended striker release when sear 100 is displaced as much as 100% of its full range of movement, including 90%-100%, 80%-90%, 70%-80%, 60%-70%, 50%-60%, 40%-50%, or other portion of the sear's full range of movement.

In use, when sear 100 is configured with first engagement surface 120 and second engagement surface 130, sear 100 is configured to arrest forward movement of striker 16 after an unintended striker release. That is, except when the striker 16 is released from first engagement surface 120 by user action, such as a trigger pull or disassembly of the handgun, the first engagement surface 120 or second engagement surface 130 will engage striker catch 20 after sear 100 disengages from first engagement surface 120. The displacement of sear 100 due to an impulse and recovery of sear 100 towards the cocked position after an unintended striker release occurs far more rapidly than the displacement and recovery of sear 100 due to a trigger pull or other user action. This is because a trigger pull is comparatively a much slower action. Also, components of the fire control group 10 (e.g., a disconnector) may maintain sear 100 in the displaced position until after striker 16 has moved distally to strike the ammunition primer (or equivalent position) when the trigger 30 is pulled. This difference in the time required for the sear to displace and recover advantageously enables sear 100 with first engagement surface 120 and second engagement surface 130 to be used both for firing the handgun in the normal course of operation by pulling the trigger, and to prevent the handgun from firing due to an unintended striker release, such as one caused by an impulse.

An impulse or sudden force to the handgun can occur, for example, due to an explosion, impact with a flying object, a sudden stop, or other event causing inertial forces on the sear 100, striker 16, or other components to release striker 16 from first engagement surface 120 of sear 100. In one example scenario, a striker-fired handgun is subjected to a nearby explosion that produces a shock wave. The shock wave is an impulse that displaces sear 100 sufficiently to disengage striker catch 20 from first engagement surface 120. After being displaced, sear 100 returns sufficiently towards the cocked position so that second engagement surface 130 is in the path 125 of striker catch 20 before striker catch 20 travels distally beyond second engagement surface 130. As such, second engagement surface 130 engages striker catch 20 and stops striker 16 from moving forward to impact the ammunition primer or attain an equivalent position. Accordingly, an inadvertent discharge is avoided.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A sear for a striker fired handgun; the sear comprising:

a sear body extending between a distal end portion and a proximal end portion, the sear body pivotable about the distal end portion and defining a first engagement surface and a second engagement surface between the first engagement surface and the distal end portion, wherein the first engagement surface and the second engagement surface face proximally and each of the first engagement surface and the second engagement surface configured to retain a striker in a rearward position, wherein the striker is configured to move along a bore axis of the handgun between the rearward position and a forward position; and a lower arm extending down from the distal end portion of the sear body, the lower arm configured to contact a trigger bar moving along the bore axis to pivot the sear about the distal end portion.

2. The sear of claim 1, wherein the first engagement surface and the second engagement surface are defined along a top portion of the sear body.

3. The sear of claim 2, wherein when the first engagement surface is oriented vertically, a first tip of the first engagement surface is vertically higher than a second tip of the second engagement surface.

4. The sear of claim 2, wherein the second engagement surface is defined at least in part by a recess in the top portion located distally of the first engagement surface.

5. The sear of claim 2, wherein one or both of the first engagement surface and the second engagement surface is defined by a vertical face connected to a surface sloping upwardly and proximally along the top portion of the sear body.

6. A fire control assembly for a semiautomatic handgun, the fire control assembly comprising:

a sear with a top portion extending from a proximal end portion to a distal end portion, wherein the top portion defines a first engagement surface and a second engagement surface positioned distally of the first engagement surface, the first engagement surface and the second engagement surface each configured to retain a striker in a rearward position, and wherein the sear is pivotable about the distal end portion between a cocked position and a displaced position, the sear including a lower arm extending down from the distal end portion, the lower arm configured to contact a trigger bar moving along the bore axis to pivot the sear about the distal end portion;

a sear spring acting on the sear to bias the sear towards the cocked position; and a striker with a striker catch, the striker movable along a bore axis between a rearward position and a forward position, wherein the striker catch engages the first engagement surface when the striker is in the rearward position and the sear is in the cocked position;

wherein, except when the sear is moved to the displaced position as a result of user action, the sear is configured to recover from the displaced position in which the striker catch is disengaged from the first engagement surface to a recovered position in which the second engagement surface is in a path of the striker catch.

7. The fire control assembly of claim 6, wherein the user action is one or more of (i) a trigger pull or (ii) operating a takedown lever, causing the sear to move to the displaced position.

8. The fire control assembly of claim 6, wherein the user action maintains the sear in the displaced position for more than 0.1 second.

9. The fire control assembly of claim 6, wherein the user action maintains the sear in the displaced position for more than 0.2 second.

10. The fire control assembly of claim 6, wherein the displaced position is a fully displaced position of the sear.

11. The fire control assembly of claim 6, wherein the sear moving to the displaced position is due to an impulse.

12. A semiautomatic handgun comprising:

a frame with a receiver;

a sear pivotably connected to the receiver, the sear including a sear body with a top portion extending between a distal end portion and a proximal end portion, the top portion defining a first engagement surface and a second engagement surface between the first engagement surface and the distal end portion, the sear also including a lower arm extending down from the distal end portion, the lower arm configured to contact a trigger bar moving along the bore axis to pivot the sear about the distal end portion, wherein the first engagement surface and the second engagement surface face proximally and each of the first engagement surface and the second engagement surface configured to retain a striker in a rearward position, and wherein the sear is pivotable about the distal end portion between a cocked position and a displaced position;

a sear spring disposed between an inside of the frame and the proximal end portion of the sear, the sear spring configured to bias the sear towards the cocked position; and a striker with a striker catch, the striker movable along a bore axis between a rearward position and a forward position, wherein the striker catch engages the first engagement surface when the striker is in the rearward position and the sear is in the cocked position.

13. The semiautomatic handgun of claim 12, wherein the displaced position is sufficient to disengage the striker catch from the first engagement surface.

14. The semiautomatic handgun of claim 13, wherein, the sear is configured to recover from the displaced position to engage the striker catch and arrest distal movement of the striker except when the sear is moved to the displaced position as a result of user action selected from (i) a trigger pull or (ii) operating a takedown lever.

15. The semiautomatic handgun of claim 14, further comprising a takedown lever; and a trigger bar coupled to the takedown lever, the trigger bar configured to pivot the sear about the distal end portion to release the striker from engagement with the sear when the takedown lever is moved to the takedown position.

16. The semiautomatic handgun of claim 14, wherein the user action maintains the sear in the displaced position for more than 0.1 second.

17. The semiautomatic handgun of claim 12, wherein a tip of the first engagement surface is vertically higher than a tip of the second engagement surface when the first engagement surface is oriented vertically.

18. The semiautomatic handgun of claim 12, wherein the top portion defines a recess between the first engagement surface and the second engagement surface.

19. The semiautomatic handgun of claim 12, wherein the top portion is aligned along a path of the striker catch.

20. The semiautomatic handgun of claim 12, wherein when the sear is displaced so that the first engagement surface is moved out of a path of the striker catch, the second engagement surface is also out of the path of the striker catch.

* * * * *